US011780203B2

(12) United States Patent
Greenwell

(10) Patent No.: US 11,780,203 B2
(45) Date of Patent: Oct. 10, 2023

(54) PAPER CRUMPLING MACHINE

(71) Applicant: BLUEGRASS BUSINESS PRODUCTS, INC., Bradenburg, KY (US)

(72) Inventor: Owen Patrick Greenwell, Brandenburg, KY (US)

(73) Assignee: Bluegrass Business Products, Inc., Brandenburg, KY (US)

( * ) Notice: Subject to any disclaimer, the term of this patent is extended or adjusted under 35 U.S.C. 154(b) by 61 days.

(21) Appl. No.: 17/011,972

(22) Filed: Sep. 3, 2020

(65) Prior Publication Data

US 2021/0122133 A1 Apr. 29, 2021

Related U.S. Application Data

(63) Continuation-in-part of application No. 16/558,734, filed on Sep. 3, 2019, now Pat. No. 11,590,724.

(60) Provisional application No. 62/895,400, filed on Sep. 3, 2019.

(51) Int. Cl.
*B31D 5/00* (2017.01)

(52) U.S. Cl.
CPC .... *B31D 5/0052* (2013.01); *B31D 2205/0023* (2013.01); *B31D 2205/0047* (2013.01); *B31D 2205/0082* (2013.01); *B31D 2205/0088* (2013.01)

(58) Field of Classification Search
CPC ..... B31D 5/0052; B31D 2205/0023; B31D 2205/0047; B31D 2205/0082; B31D 2205/0088
See application file for complete search history.

(56) References Cited

U.S. PATENT DOCUMENTS

| | | | | | |
|---|---|---|---|---|---|
| 3,509,797 | A | | 5/1970 | Johnson | |
| 3,911,771 | A | * | 10/1975 | Schleifenbaum | G03B 27/588 83/261 |
| 3,921,506 | A | * | 11/1975 | Hollis | B31D 5/0073 493/213 |
| 4,016,805 | A | * | 4/1977 | Hollis | B31D 5/0073 493/227 |
| 5,203,761 | A | | 4/1993 | Reichental | |
| 5,488,467 | A | * | 1/1996 | Marentes | G03G 15/652 399/68 |
| 5,593,376 | A | | 1/1997 | Armington | |
| 5,730,696 | A | | 3/1998 | Simmons | |
| 5,942,076 | A | * | 8/1999 | Salerno | B65B 9/13 156/359 |
| 6,015,374 | A | | 1/2000 | Murphy | |
| 6,120,428 | A | * | 9/2000 | Ratzel | B65H 20/02 493/464 |
| 6,179,765 | B1 | * | 1/2001 | Toth | B65H 16/06 493/464 |

(Continued)

FOREIGN PATENT DOCUMENTS

| | | | | |
|---|---|---|---|---|
| WO | WO-2017053285 A1 | * | 3/2017 | B31D 5/0073 |

*Primary Examiner* — Thomas M Wittenschlaeger
*Assistant Examiner* — David G Shutty
(74) *Attorney, Agent, or Firm* — Carrithers Law Office, PLLC; David W. Carrithers

(57) ABSTRACT

A machine for pulling paper off of a roll and crumpling the paper increasing the surface area and bulk of the compressible crumpled paper. The crumpled paper is used as packing material, cushioning packaged parts and filling package voids.

12 Claims, 9 Drawing Sheets

(56) References Cited

U.S. PATENT DOCUMENTS 6,217,498 B1 4/2001 Simmons
6,273,360 B1 8/2001 Robinson
6,503,182 B2 * 1/2003 Toth ..... B65H 23/08 493/967
6,632,165 B1 * 10/2003 Letourneau ..... B31D 5/0052 493/464
7,651,455 B2 * 1/2010 Yampolsky ..... B31D 5/0052 493/464
7,744,519 B2 * 6/2010 Wetsch ..... B31D 5/0052 493/464
8,177,701 B2 5/2012 Kung
8,419,606 B2 4/2013 Carlson
8,435,165 B2 5/2013 Bock
8,499,691 B2 * 8/2013 Bangel ..... B41F 13/32 101/247
8,550,971 B2 10/2013 Chan
8,696,345 B2 4/2014 Sprick-Schutte
8,708,882 B2 4/2014 Chan
8,997,440 B2 * 4/2015 Carlson ..... B65B 55/20 53/115
9,370,914 B2 6/2016 Demers
9,676,586 B2 6/2017 Cheich
9,694,554 B2 7/2017 Mulvey
2003/0073558 A1 * 4/2003 Chesterson ..... B31D 5/0052 242/350
2005/0215408 A1 * 9/2005 Yampolsky ..... B26F 1/22 493/464
2007/0066472 A1 3/2007 Harding
2007/0117703 A1 5/2007 Cavaliere
2008/0098699 A1 5/2008 Cheich
2009/0258775 A1 * 10/2009 Chan ..... B31D 5/0043 493/464
2011/0053742 A1 * 3/2011 Wetsch ..... B31D 5/0052 493/27
2011/0053750 A1 * 3/2011 Wetsch ..... B31D 5/006 493/464
2017/0100906 A1 * 4/2017 Beaver ..... B31D 5/006
2020/0139661 A1 * 5/2020 Greenwell ..... B31D 5/0052

* cited by examiner

PAPER CRUMPLING MACHINE

CROSS REFERENCES TO RELATED APPLICATIONS

This application is a Continuation-In-Part of U.S. application Ser. No. 16/558,734 filed on Sep. 3, 2019 and claims priority from U.S. Provisional Application Ser. No. 62/895,400 filed on Sep. 3, 2019 both of which are incorporated by reference in their entirety.

TECHNICAL FIELD

The present invention relates to the field devices used to crumple paper which is pulled from a roll and then used as filler and cushioning around objects being packaged in boxes.

BACKGROUND OF THE INVENTION

Products to be stored or delivered are generally packaged in a box or other type of container. Normally, a given product does not fit perfectly with in the box some sort of packing material is needed to fill voids and otherwise cushion the product within the box. The packing material used to fill void space within a container is typically a lightweight, air-filled material that may act as a pillow or cushion to protect the product within the container. Frequently, a plastic bubble material is used to protect and cushion the product contained within a container. However, plastic bubble material can be expensive and time-consuming to produce. Further, plastic bubble material is not form fitting and in many instances, voids are still present within a 'filled' package. Still further, plastic bubble material is not "environmentally friendly" in that these materials are not readily biodegradable when exposed to the environment.

Small Styrofoam pellets or "peanuts" may also be used to fill voids within containers for protecting and cushioning a product within those containers during transport. Again, such styrene packing is not environmentally friendly. Packing material made from paper is biodegradable, highly flexible in terms of use, and is comparably inexpensive.

U.S. Pat. No. 7,744,519 for SYSTEM AND METHOD FOR CRUMPLING PAPER SUBSTRATES by Wetsch et al which issued on Jun. 29, 2010 teaches a machine which crumples paper pulled from a roll of paper. The machine includes a motor driven drive roller with an idling pressure roller, a wire-form feed chute and a braking system for the paper roll including 'tapered caps' which support the roll from inside but do not rotate, causing the roll's inner core to slide on the caps, thus providing braking friction, and further braking is provided by a strut with a curved surface which can contact the roll to impede rolling action.

SUMMARY OF THE INVENTION

A paper crumpler, comprising, consisting essentially of, or consisting of a a first stand for supporting a paper crumpler, a second stand for supporting a paper roll assembly. The paper crumpler includes a housing, a centrally disposed vertical support plate having top and bottom flanges, a feed chute for receiving a paper ribbon affixed on a first side of the vertical support plate. A drive roller extends from the first side of the vertical support plate on an output shaft of a motor affixed to an opposing second side of the vertical support plate. A first idler roller and a second idler roller are spaced apart and in-line with one another rotatably connected to a rocker plate allowing pivotal movement. The rocker plate pivotally connects to the first side of the vertical support plate having one end connected to a spring for biasing the first idler roller and the second idler roller against the drive roller offset and disposed therebetween. A diverter plate extends from the first side of the vertical support plate disposed over the drive roller and between the first idler roller and the second idler roller. A feed chute is affixed to the first side of the vertical support plate in line with the first idler roller. Aa discharge chute is affixed to the first side of the vertical support plate in line with the second idler roller. A motor controller in electrical communication with the motor powers an on switch, a speed select switch, a paper feed switch, and a foot feed. The second stand includes a paper roll cradle including a panel extending from a pair of spaced apart trapezoid shaped side plates at a selected upward angle forming an upward sloped wall. A roller guard opposes the panel extending from an opposing top corner of each one of the trapezoid shaped side plates. A rear longitudinal member extends between a bottom rear corner of each one of the trapezoid side panels below the roller guard. A paper roll idler roller extends between the trapezoid shaped side plates at a selected position near a bottom center section of the opposing trapezoid shaped side plates spaced apart from and between the panel and the rear longitudinal member. The paper roll idler roller supports a paper roll at rest cradled against the panel. Pulling a paper ribbon sheet feeding from the paper roll forward rotates the paper roll moving it forward positioned over the paper roll idler redistributing the weight on the top of the paper roll idler preventing the paper roll from touching a surface of the panel. Reducing or stopping pulling of the paper ribbon sheet forward produces slack in the paper ribbon sheet allowing the paper roll to rock back against the panel imparting drag and providing a frictional brake to rotation of the paper roll preventing free wheeling and bird nesting of the paper ribbon sheet feed. The feed paper guide hangs down from a bottom edge of the feed chute and guiding paper into the feed chute. The feed paper guide curves upward into a path of feed paper flow and provides frictional dampening against a bottom surface of feeding paper. A coating or lining can be applied to the panel for enhancing friction between the panel and the paper roll. A detachable paper feed dampener can extend from the feed chute with a free distal end for flexing and dampening the paper ribbon sheet feeding thereover from the paper roll cradle to the paper crumpler. An adjustable arm attaching near the proximate end of the detachable paper feed dampener extending toward the first stand. The adjustable arm attaches to the first stand permitting limited flexing of the feed dampener and positioning of the distal end of the paper dampener for alignment with the paper ribbon sheet pulled from the paper roll.

More particularly, in accordance with the present invention, there is provided a paper crumpling machine for crumpling paper pulled from a roll. The apparatus comprises, consists essentially of, or consists of a floor stand base supporting a first forward stand or vertical support member providing a pedestal supporting a paper crumpler and a second rearward stand or vertical support member providing a pedestal supporting a paper roll cradle. The paper crumpler is supported on the first stand and includes a housing having a front side, a back feed side, a left side, a right side, at top, and bottom. The paper crumpler includes a feed chute facing inwardly toward a generally rectangular feed opening in the housing. The paper sheet feed chute is generally rectangular and includes a top and a bottom panel connected by side panels having smooth sides and curved or angled inwardly from the entrance to the exit forming a conical opening leading into a roller assembly including a first idler roller, a drive roller, and a second idler roller.

The driven roller is fixed on an output shaft of a motor. The first rear idler roller is rotatably connected to a rocker plate which is pivotally connected to the bottom surface of a pressure plate supported by a vertical support plate having an upper and lower flange defining an "I-beam" configuration centrally disposed extending from the front to the back of the device. The end of the pressure plate near the discharge chute is pivotally connected to a vertical back plate of the paper crumpler. The opposing end of the pressure plate is connected to the first end of an extension spring attached to the vertical support plate. The second end of the extension spring extends to the right and downward about fifteen degrees and is connected to a pin extending from the vertical support plate. A spring is tensioned to apply paper pulling force from the first idler roller against the driven roller. The rocker plate having a second horizontal rear idler roller rotatably connected thereto and pressing against the driven roller. The first and the second idlers are spaced apart on the rocker plate with the first idler roller contacting the driven roller at about 1:30 (the angle made by the minute hand on an analog watch at the hour of one thirty) with respect to the driven roller and the second idler contacting the driven roller at about 9:00 with respect to the driven roller. The rocker plate includes a diverter plate extending end to end from the first idler roller toward the second idler roller.

The paper crumpler housing has a crumpled paper exit chute opposite the feed chute. The chute opening faces between the driven roller and the second idler roller. The paper feed chute exit is generally rectangular having upper and lower flanges connected by side flanges. The motor is attached on a side panel. A motor controller is attached to the rear side of the side panel in close proximity thereto. The motor controller has a power on switch, a speed select switch, a paper feed switch, and a foot feed switch electrically connected thereto.

The second vertical stand has a paper roll cradle fixed thereto comprising a first plate or tray extending outward from the first stand and is mounted on the second stand at an angle of about sixty degrees above horizontal, a second plate extends inwardly toward the first stand from a top edge of the second stand at an angle of about fifteen degrees above horizontal and a horizontal paper roll support roller. A horizontal paper roll support roller is affixed thereto about one inch above an inside surface of the second plate and parallel to the first and the second plates. The paper roll support roller is spaced about five inches from the first plate.

Projecting forward from the feed chute is a detachable dampener feed paper guide. The feed paper guide hangs down from the feed chute toward the paper roll and tray. Paper slides over the feed paper guide and into the feed chute. The feed paper guide curves and extends into the path of feed paper flow thereby providing frictional dampening against a bottom surface of feeding paper, especially when the motor is topped and the paper decelerates. A distal end of the feed paper tray is free to flex up and down a selected distance and the bottom is attached to an adjustable arm extending to in close proximity to a selected position on the paper crumpler stand and attached thereto by a spring permitting limited flexing or bouncing of the dampener feed paper guide. Thinner paper of about 30 lb or less comes off of roll and tends to birdnest when the paper crumbling drive roller is stopped due to the momentum of the rotating roll of paper. The removable dampener serves to prevent tearing of thinner paper upon starting and stopping the drive roller. The dampener is not necessary on heavy paper. Use of the dampener helps resist tearing of the paper when the drive roller accelerates and it can be used with center feed paper rolls or several paper rolls can be tied in series or use with horizontal rollers.

It is an object of this invention to provide a paper crumpling machine which pulls paper from a roll, crumples the paper and feeds the crumpled paper out.

It is an object of this invention to provide a paper crumpling machine which pulls paper from a roll and wherein the paper is pulled through an feed horn which has a rectangular opening with smooth edges and the opening necks down gently to a smaller rectangular output aperture.

It is an object of the present invention to provide a paper crumpling machine which crumples paper at a continuously variable speed.

It is an object of the present invention to provide a paper crumpling machine wherein the paper is captured between one drive roller and two idler rollers which provide the needed friction to pull the paper.

It is an object of the present invention to provide a paper crumpling machine which is controlled by either an adjustable switch or a foot switch.

It is an object of the present invention to provide a paper crumpling machine wherein the roll of paper is cradled between a free rolling roller and a planar surface whereby the friction between the planar surface and the roll of paper serves to keep the roll speed under control and prevent the roll from feeding out loose paper while coasting to a stop.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
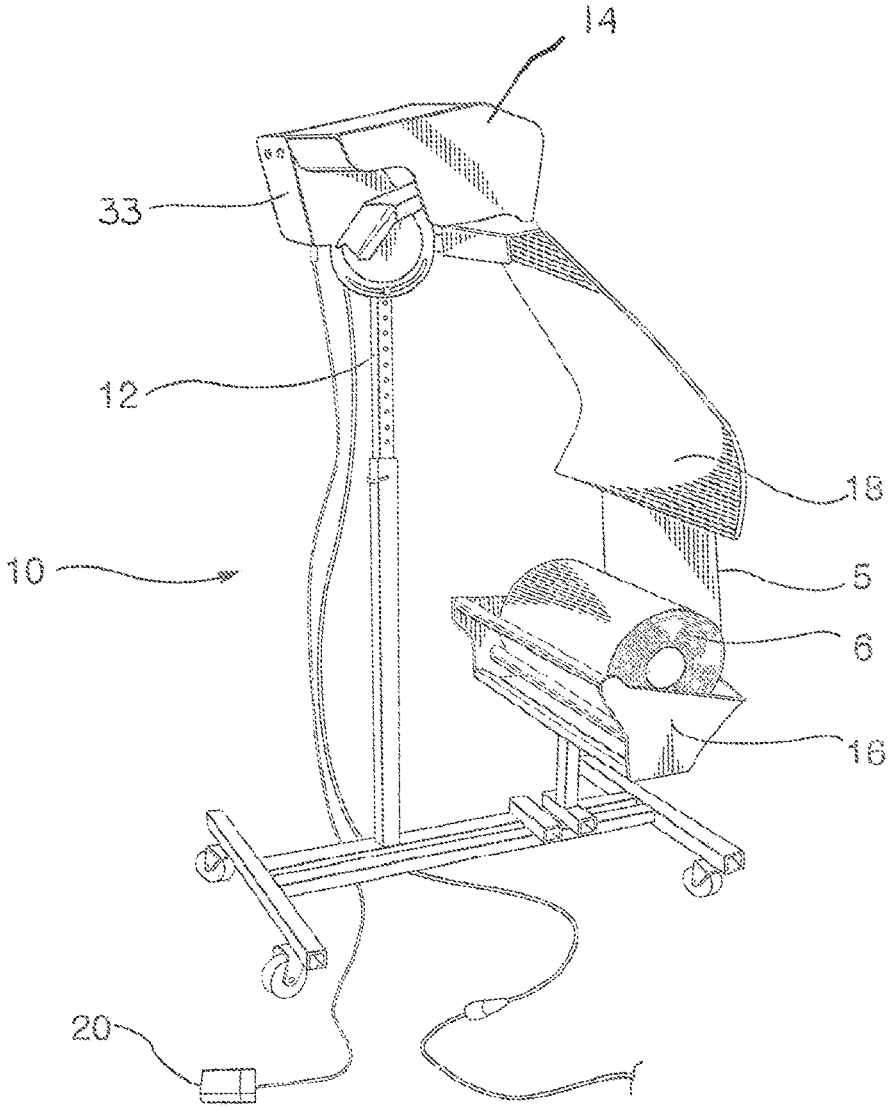
FIG. 1 is a perspective view of the paper crumpling machine.
Figure 2:
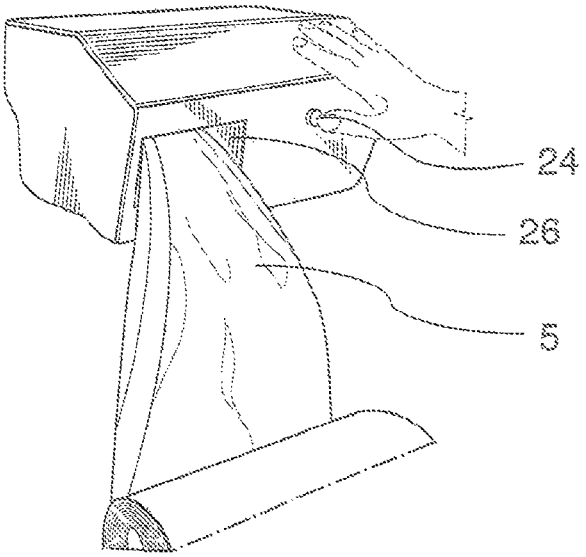
FIG. 2 is a perspective view of the housing paper feed chute pulling a ribbon sheet of paper from a paper roll.
Figure 3:
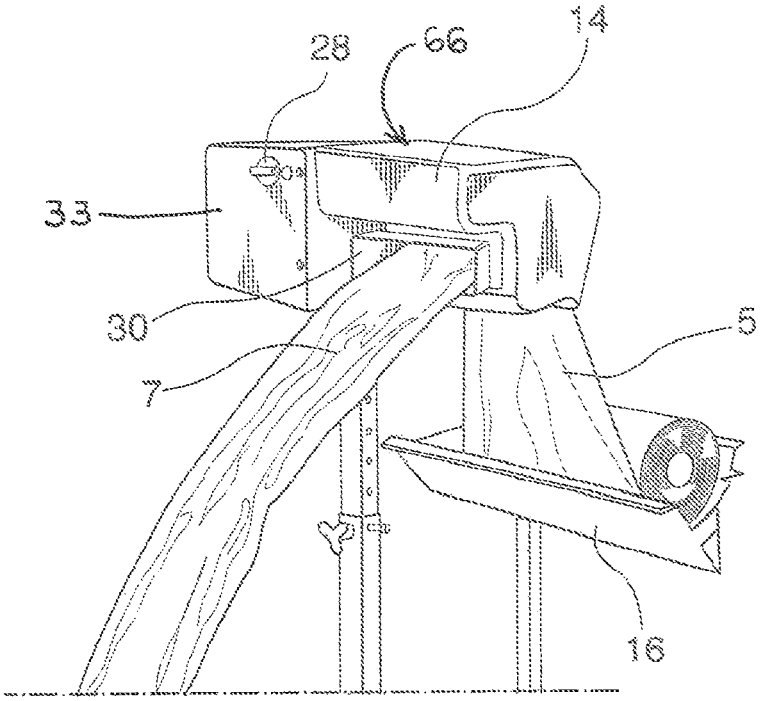
FIG. 3 is a perspective view showing crumpled paper discharged from the discharge chute of the housing and the paper feeding into the feed chute from a roll on the paper tray.
Figure 4:
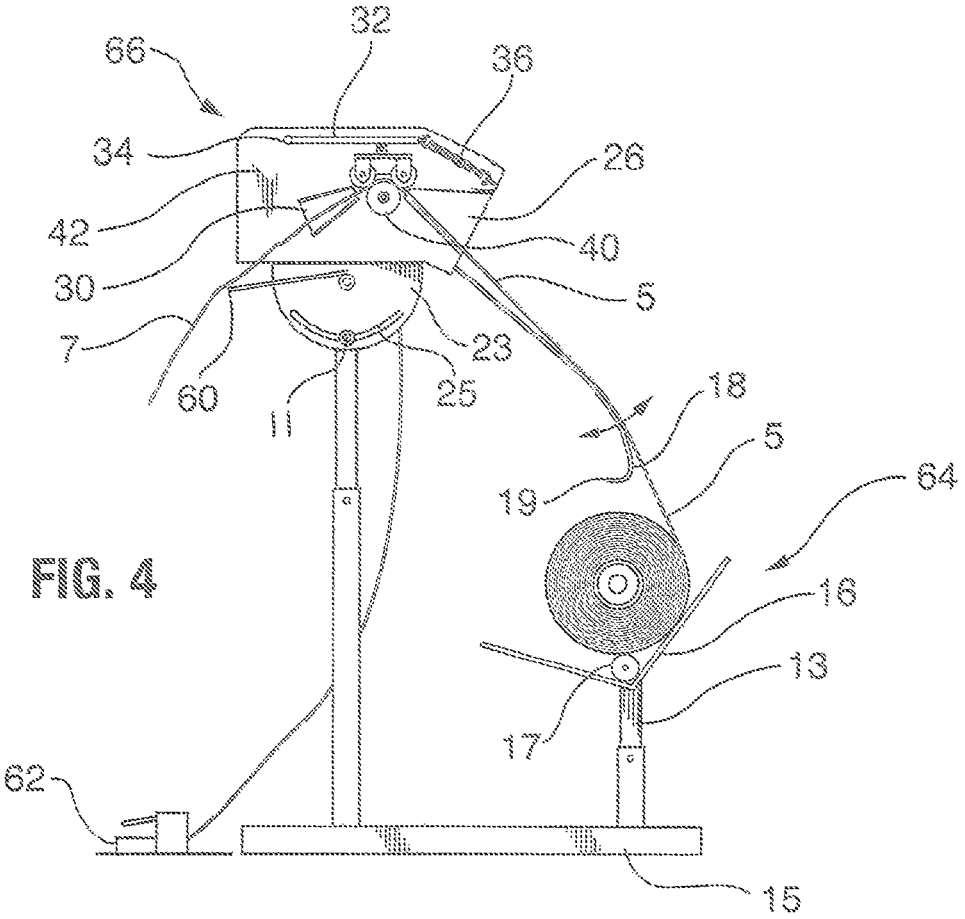
FIG. 4 is left side view of the paper crumpler with a cut-a-way section of the housing showing the paper from the roll contacting the dampener and feeding in the feed chute between the first idler roll, the drive roll, and the second idler roll and discharging from the discharging as crumpled paper from the exit chute.
Figure 5:
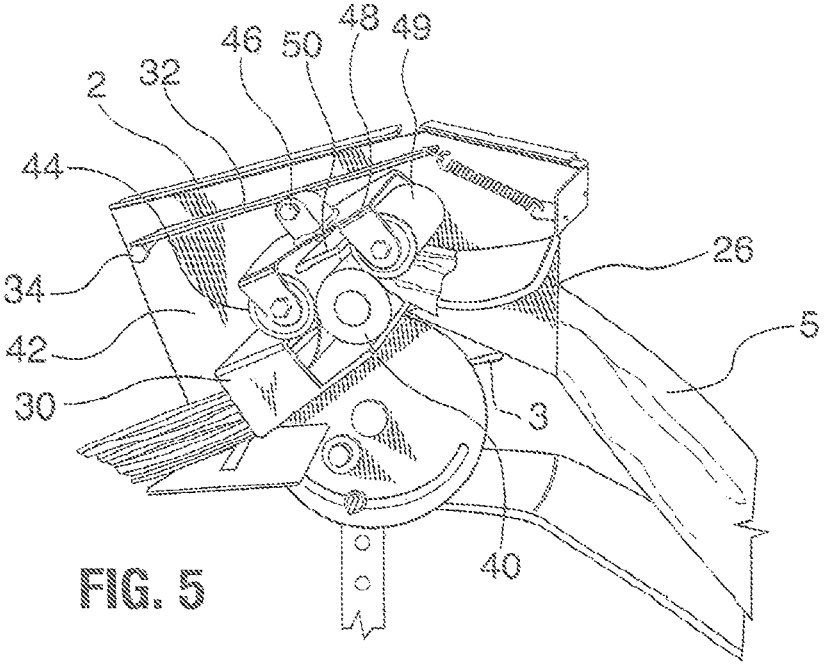
FIG. 5 is a perspective view of the paper crumbling apparatus with the housing removed to show the roller assembly diverter and feed and discharge chutes shown pivotally supported on a first side of a vertical support plate mounted to the top of the stand supported by a slotted disc.
Figure 6:
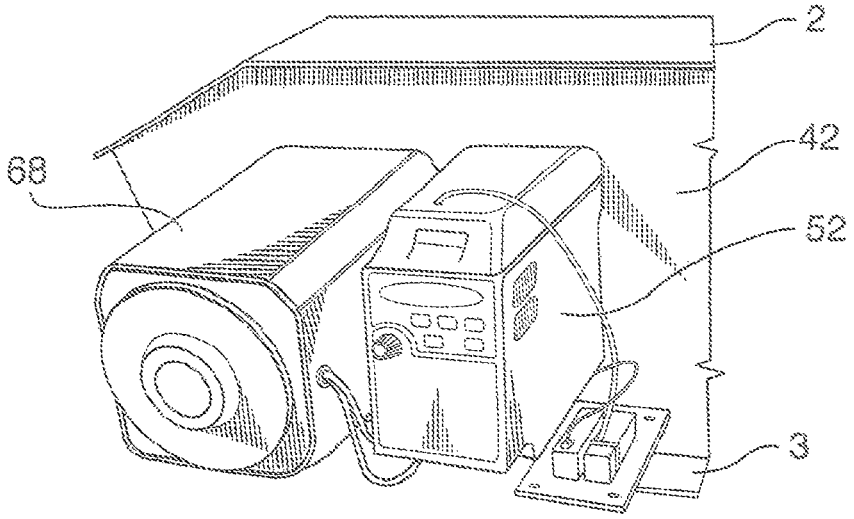
FIG. 6 is a side view showing the center support plate of the paper crumpler with the housing cover removed showing the motor and input frequency drive mounted on a second side of a vertical support plate.
Figure 7:
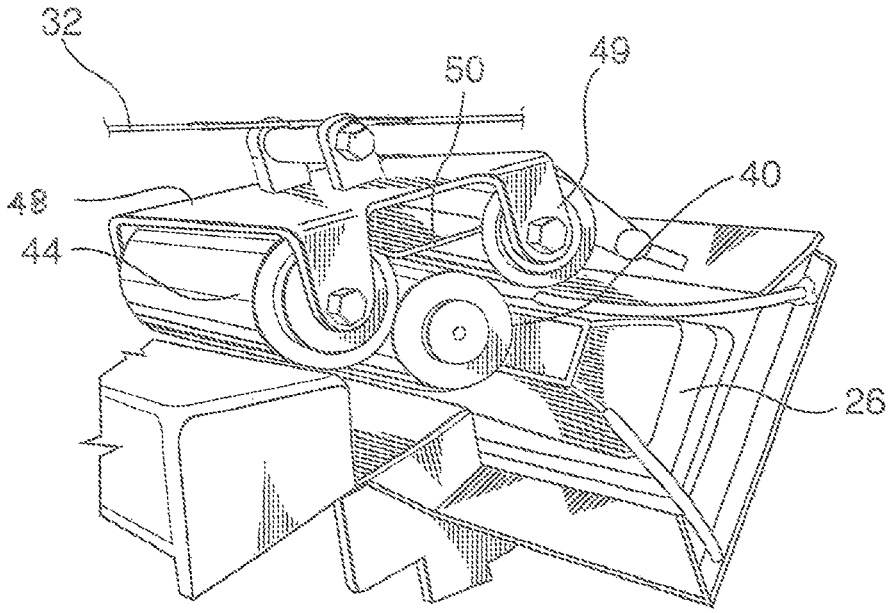
FIG. 7 is a perspective view showing the roller and diverter assembly of the paper crumpler.
Figure 8:
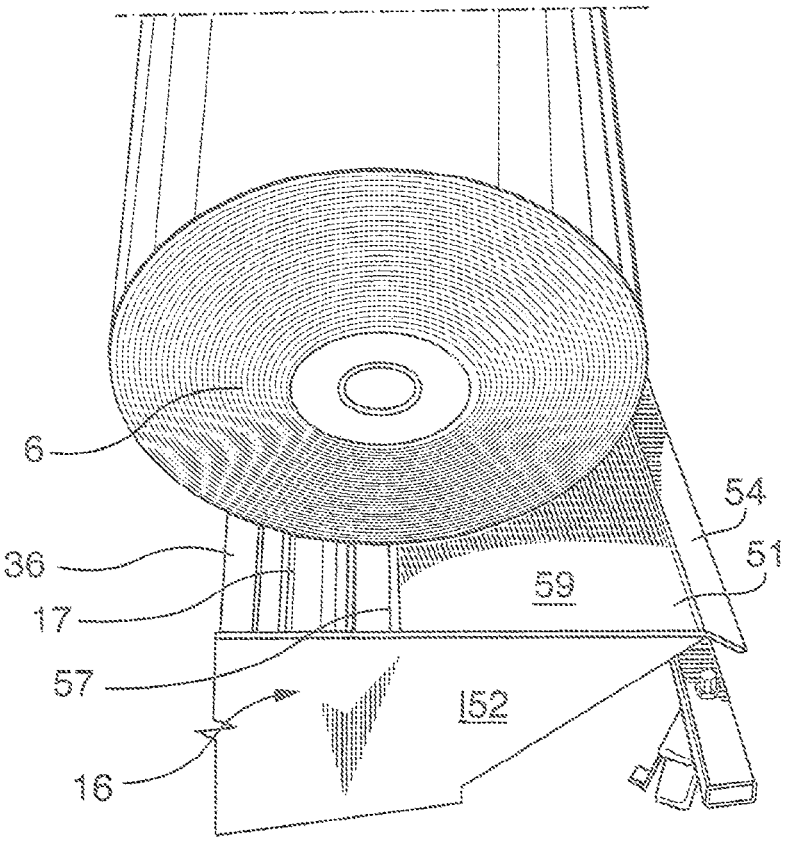
FIG. 8 is view of the paper roll in the roll support tray resting on a roller comprising a cylinder having bearings.
Figure 9:
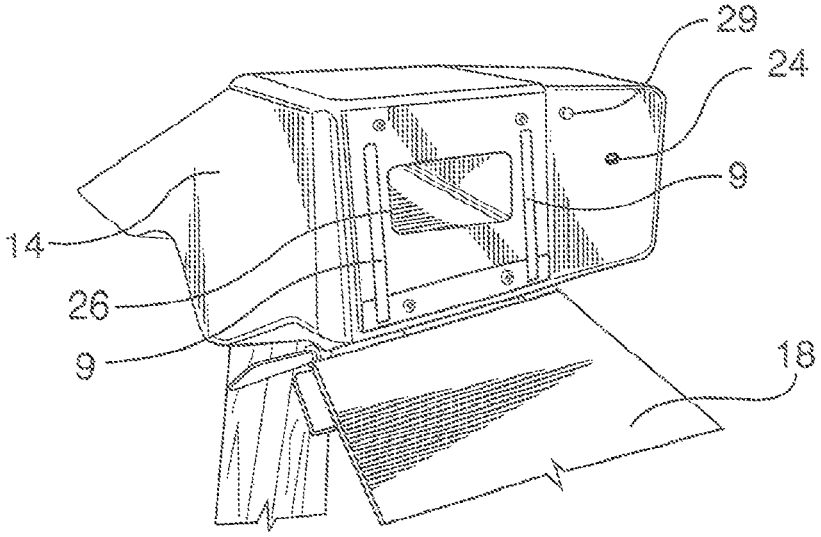
FIG. 9 is a perspective end view of the paper crumpler showing the feed chute and dampener with the vertical paper guides.
Figure 10:
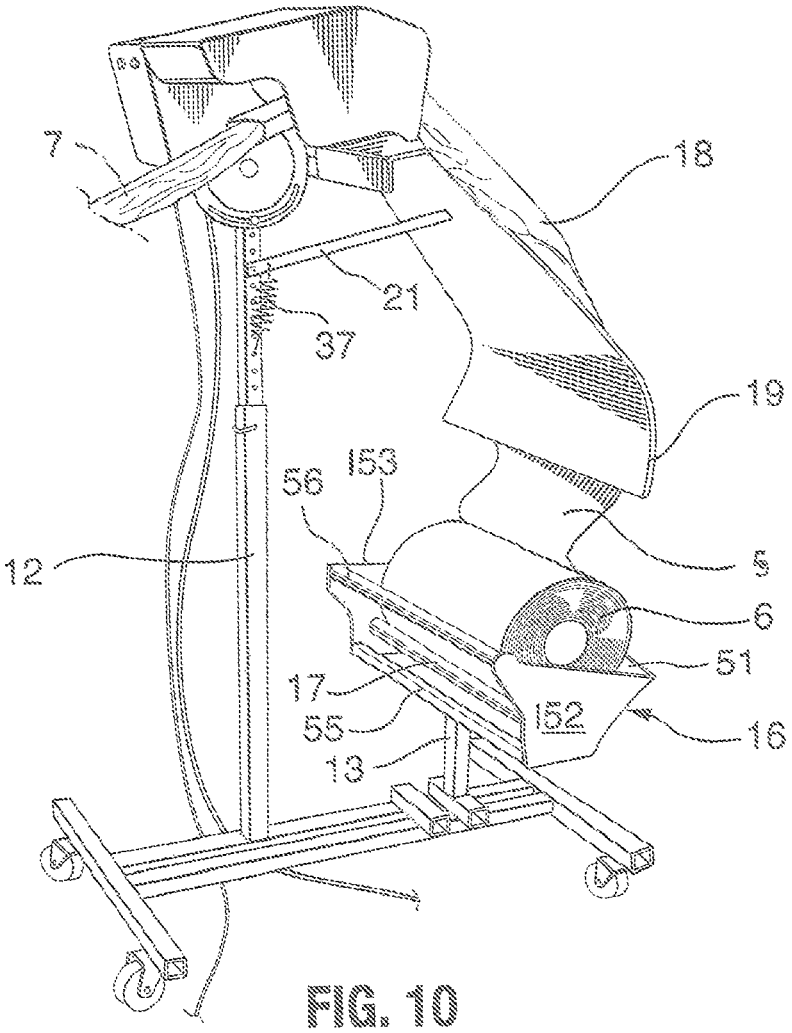
FIG. 10 is a perspective view showing paper feeding from the tray onto the dampener thorough the paper crumpler and discharging therefrom.

In accordance with the present invention, there is provided a paper crumpling machine for crumpling paper pulled from a roll.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. References to "front," "back," "rear," "upper," "lower," "right," and "left" are used to identify the various elements to a user facing the sink, and with "lateral" being left-right.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "about" can be reasonably appreciated by a person skilled in the art to denote somewhat above or somewhat below the stated numerical value, to within a range of ±10%.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In accordance with the present invention as shown in FIGS. 1-17, there is provided a paper crumpling machine 10 comprising, consisting essentially of or consisting of a floor stand base 15 with a first forward stand or vertical support member providing a pedestal 12 supporting the paper crumpling device and a spaced apart second rear stand or vertical support member providing a pedestal 13 supporting a paper unrolling tray assembly 64. The height of the stands is adjustable. The first stand 12 supports the paper crumpler 66 at a selected height above the paper tray assembly 64 supported by the second stand. The paper tray assembly can be raised to increase or decrease the distance between the paper roll 6 and the crumpler 66. The stand 15 can be fitted with wheels for portability.

The paper crumpler device includes a housing 14 covering the components having a front discharge side, a back feed side, a left side, a right side, at top, and bottom. The paper crumpler components are mounted on a centered vertical support plate "I-beam" 42 extending from the front to the back of the device having an upper flange 2 and lower flange 3. The upper flange 2 may include an obtuse angle so that a front and/or back portion of the housing 14 is in alignment with the paper feed and product discharge positioned on the floor. The paper crumbling device 66 is pivotally mounted onto the front stand 12 with a pin affixed to the vertical support plate 42 extending through the center of a vertical disc 23 and attaching to the stand 12. The vertical support plate 42 and housing 14 are held at a selected angle with respect to the ground by a bolt 11 extending through a selected one of a plurality of holes formed in the forward 12 stand a arcuate slot 25 formed in the disc 23.

The paper crumpler housing 14 includes a crumpled paper discharge chute 30 opposite the paper ribbon feed chute 26. The chute extends outward from the second front idler roller. The paper feed chute discharge 30 is generally rectangular having upper and lower flanges connected by side flanges. The motor 68 is attached to the vertical support plate 42. A motor controller 52 is attached to the rear side of the vertical support plate 42 in close proximity thereto. A variable speed control rotary switch linked to a potentiometer is in electrical communication with the 110 volt input frequency drive 52 which drives the 230 volt three phase motor. The motor controller has a power on switch 27, a speed select switch 28, a paper feed jog switch 29, and a foot feed switch 20 electrically connected thereto.

The paper crumpler includes a feed chute facing inwardly toward a generally rectangular feed opening in the housing. The paper sheet feed chute is generally rectangular and includes a top and a bottom panel connected by side panels having smooth sides with the panels being curved or angled inwardly from the entrance to the exit forming a conical opening leading into a roller assembly including a first rear idler roller, a drive roller, and a second front idler roller for pulling the paper ribbon into the paper crumpler and producing a crumpled paper product. The feed chute 26 rectangular opening is about six inches wide and about four inches high with smooth curved edges around the opening. An optional pair of vertical paper guide rollers or guide bars 9 are disposed on a horizontal flange attached to the bottom rear portion of the housing and spaced apart on each side of the feed chute 26 adjacent the chute opening.

A detachable paper feed dampener 18 helps support and guides the ribbon sheet paper 5 into the feed chute 26. The paper dampener 18 applies frictional drag to the paper 5 to help control the paper as the paper speeds up or comes to a rest when the motor stops. The dampener projects forward from the feed chute 26. The vertical center of the dampener 18 is curved outward into the paper to enhance drag. The smooth paper ribbon 5 from the paper roll 6 slides over the feed paper dampener 18 and into the feed chute of the paper crumpler. The feed paper guide curves and extends into the path of feed paper flow thereby providing frictional dampening against a bottom surface of feeding paper, especially when the motor is topped and the paper decelerates. A distal end 19 of the feed paper tray is free to flex up and down a selected distance of up to 30 degrees and preferably 5-10 degrees. The proximate end of the dampener is attached to an adjustable arm 21 extending to in close proximity to a selected position on the paper crumpler stand and attached thereto by a spring 37 attaching to the front stand 12 and permitting limited flexing or bouncing of the dampener feed paper guide and positioning of the distal end of the dampener for alignment with the paper ribbon pulled from the paper roll. Thinner paper of about 30 lb or less comes off of roll and tends to birdnest when the paper crumbling drive roller is stopped due to rotational momentum of the paper roll and the removable dampener serves to prevent tearing of thinner paper upon starting and stopping the drive roller. The dampener is not necessary on heavy paper. Use of the dampener helps resist tearing of the paper when the drive roller accelerates and it can be used with center feed paper rolls or several paper rolls can be tied in series or use with horizontal rollers.

Passing through the feed chute, the flat paper ribbon sheet 5 is threaded under a first front idler roller 49 and over a motor driven neoprene covered horizontal drive roller 40 and under a neoprene covered horizontal rear idler roller 44. The idler 49 is pressed or biased against the driven roller 40 by a rocker plate 48 which rotatably holds the first idler roller 49 and the second idler 44 horizontally against the driven roller 40. The two idlers 49 and 44 are spaced apart so that idler 49 contacts the driven roller 40 at about 1:30 (the angle made by the minute hand on an analog watch at the hour of one thirty) with respect to driven roller 40 and idler 44 contacts driven roller 40 at about 9:00 with respect to the driven roller 40. The rocker plate 48 is pivotally connected to the bottom surface of the upper flange 32 by a pair of spaced apart aligned lugs 39, 41 having holes there through, projecting upward from the upper surface of the rocker plate and pivotally secured to a sleeve 47 held by a bolt 46 projecting thorough a sleeve 47 attaching to the plate 42. The upper flange 32 is pivotally connected at the rear end to the vertical support plate 42 by a pin 34 and the front free end of the flange and an extension spring 36 secured to a stud on the plate 42 attaches at the front feed end of the upper flange 32. The free end of the spring 36 extends to the front feed end and downward at an effective selected distance and effective angle of up to about fifteen degrees below horizontal and is attached to a pin above the open end of the feed chute 26, with the spring tensioned to maintain contact of both idlers 49 and 44 against the driven roller 40 with effective force to cause the ribbon sheet of paper 5 to be pulled form the paper roll 6 by the drive roller 40.

Using double idler rollers provide more surface contact with the drive roller and less pressure on the two idler rollers which pivot off point to work independently. By utilizing two spaced apart idler rollers 44, 49 it is not necessary to smash or flatten the ribbon sheet of paper in order to grip it with the drive roller 40 so the paper being fluffed without flattening it creating undesired creases. The position of the idler rollers 44, 49 actually cause paper to encircle part of drive roller 40 resulting in increased surface area of paper in contact with drive roller increasing traction of the paper on drive roller as compared with conventional paper crumpler with a single idler roller which requires more power and pull from drive wheel and more aggressive pulling, stretching, breaking, and flattening of paper being pulled therethrough.

There is a paper diverter plate or block 50 between the idler rollers which causes the paper to initially be diverted downward when threading the paper into the machine. The diverter plate preferably comprises a block of TEFLON or nylon or other material having a slippery surface and extended wear capability. The paper diverter guide 50 directs paper between the drive roller 40 and rear idler roller 44 and prevents paper from bypassing and diverting over the top of the second idler roller 44 instead of between drive roller 40 and idler roller 44.

As the paper runs between the idler 44 and drive roller 40, the paper enters and exits the discharge chute 30 and exits the machine. Below the discharger chute is a knife 60 which can be used by an operator to drag the crumpled paper 7 against and tear a piece off. having the idler rollers 44 and 49 on each side of the drive roller improves the control and gives a firm drive force to the paper. The drive roller 40 and the two idlers 44 and 49 are about seven inches wide.

The spring loaded roller assembly allows the spaced apart idler rollers 44 and 49 to wobble or pivot within selected distance to accommodate varying widths of incoming paper feed and maintain bias of the rollers against the drive pulley 40. By placing the drive roller 40 between double idler rollers 44, 49 more friction is applied to the paper due to the increased surface areas of the rollers. Furthermore, mounting the idler rollers 44, 49 on a rocker plate spindle to swivel allows them to self align in accordance with the angle of paper feed.

Figure 11:
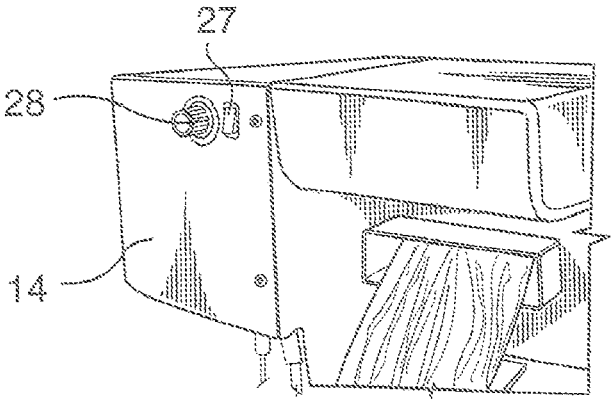
FIG. 11 is another view of the discharge chute of the paper crumpler and the variable speed control for the potentiometer of the 110 volt input frequency drive drives for the 230 volt three phase motor.
Figure 12:
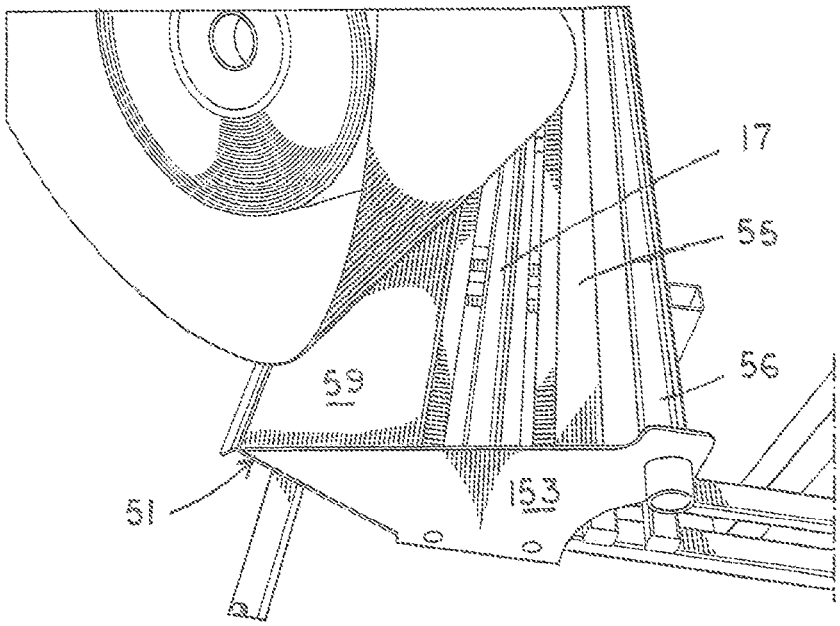
FIG. 12 is a perspective view of the paper roll tray showing the roll support cylinder, front stop bar and rear friction tray panel.
Figure 13:
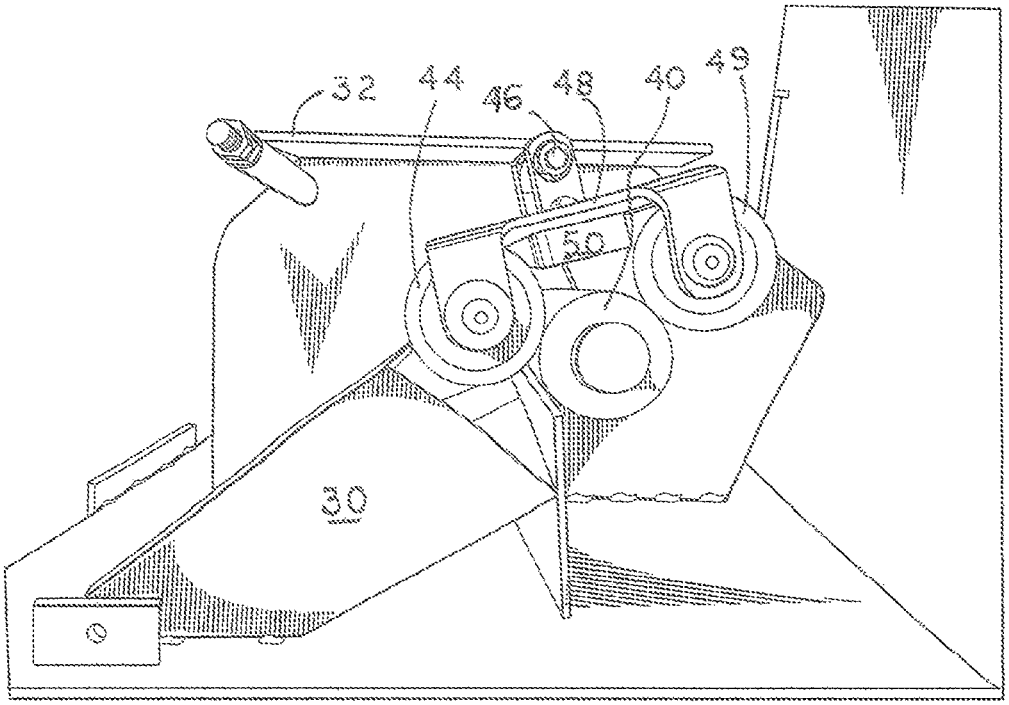
FIG. 13 is a side view showing the pivoting idler roller assembly pivotally attached to the center support plate and the drive roller disposed below and between the pivoting idler rollers and the deflector block positioned between the front and rear idler rollers biased against the drive roller by a spring extending from the distal end to the opposing end of the plate.
Figure 14:
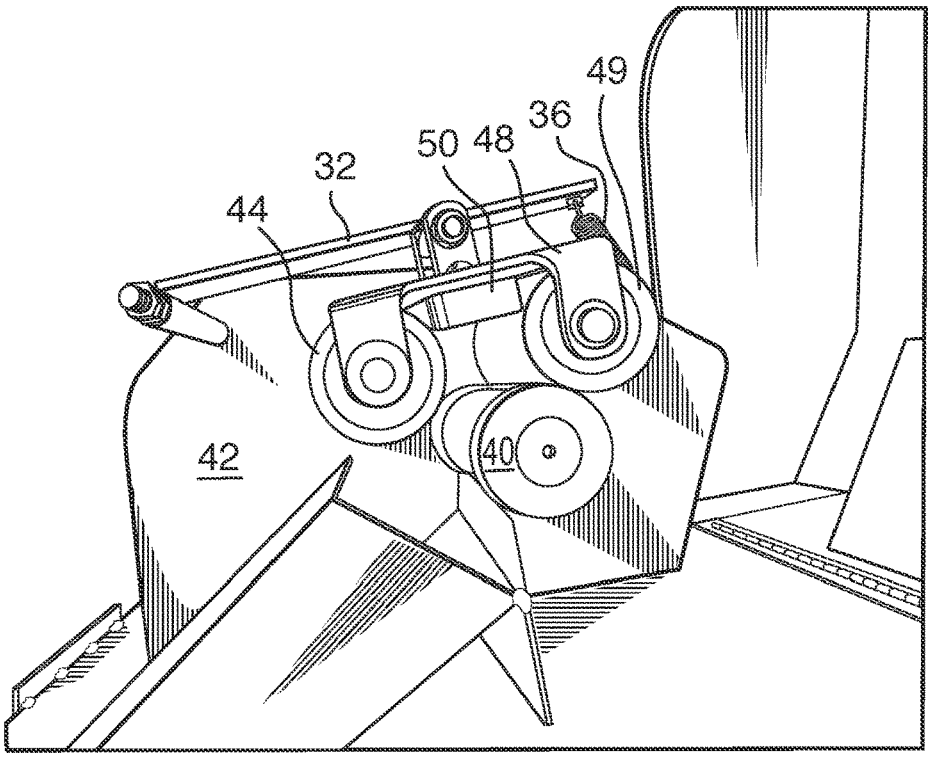
FIG. 14 is a side view showing the pivoting idler roller assembly pivotally attached to the center support plate and the drive roller disposed below and between the pivoting idler rollers and the deflector block positioned between the front and rear idler rollers biased against the drive roller by a spring pulled upward and extended showing spacing between the rollers.
Figure 15:
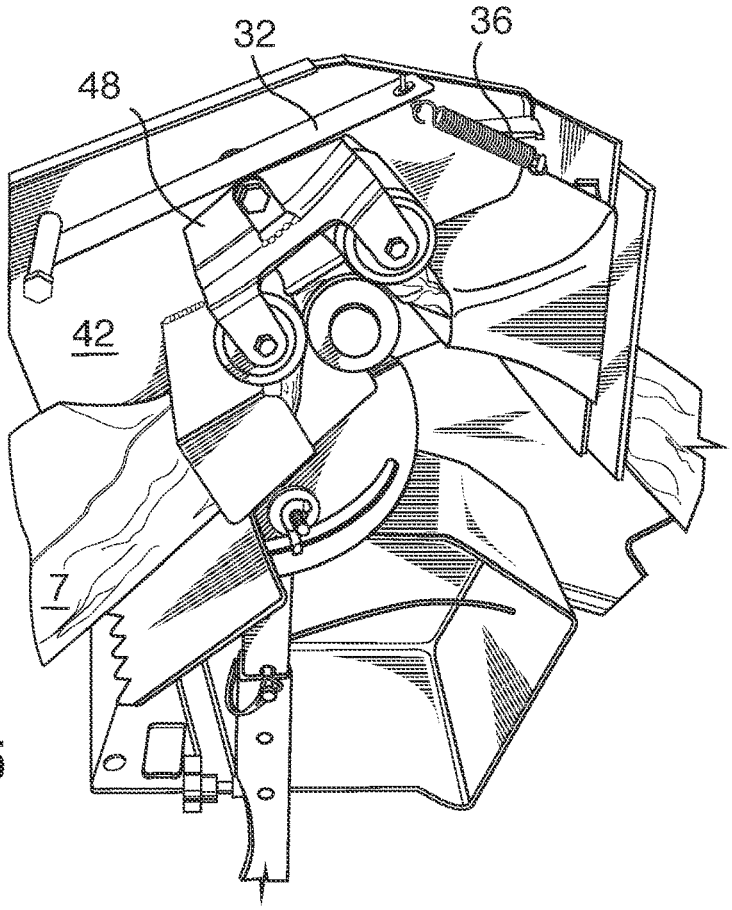
FIG. 15 is a side view showing the paper ribbon sheet entering through the feed chute threaded between the idler rollers and drive roller and crumpled paper discharged through the discharge chute.
Figure 16:
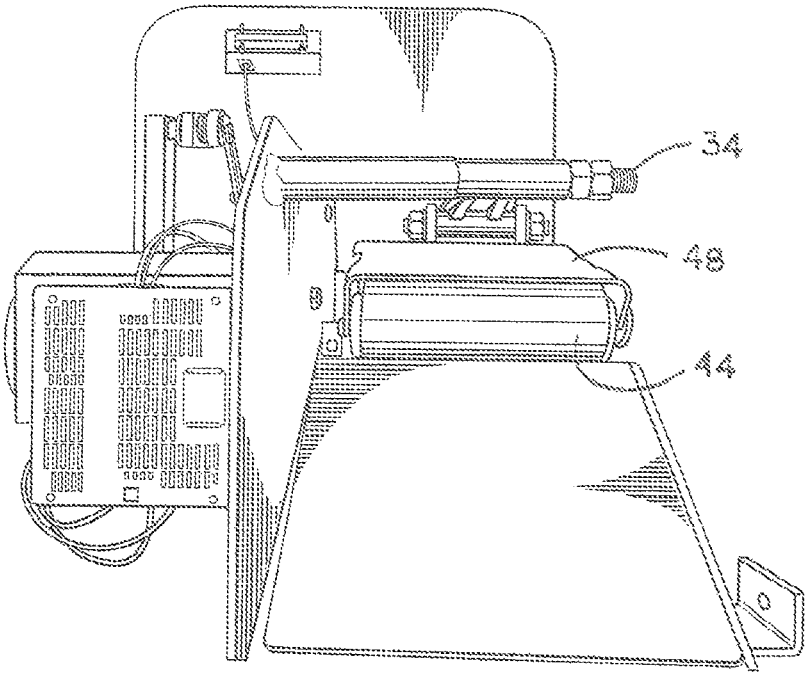
FIG. 16 is an end view of the pivoting idler roller assembly pivotally attached to the center support plate and showing a discharge chute floor panel, and closed housing limit switch.
Figure 17:
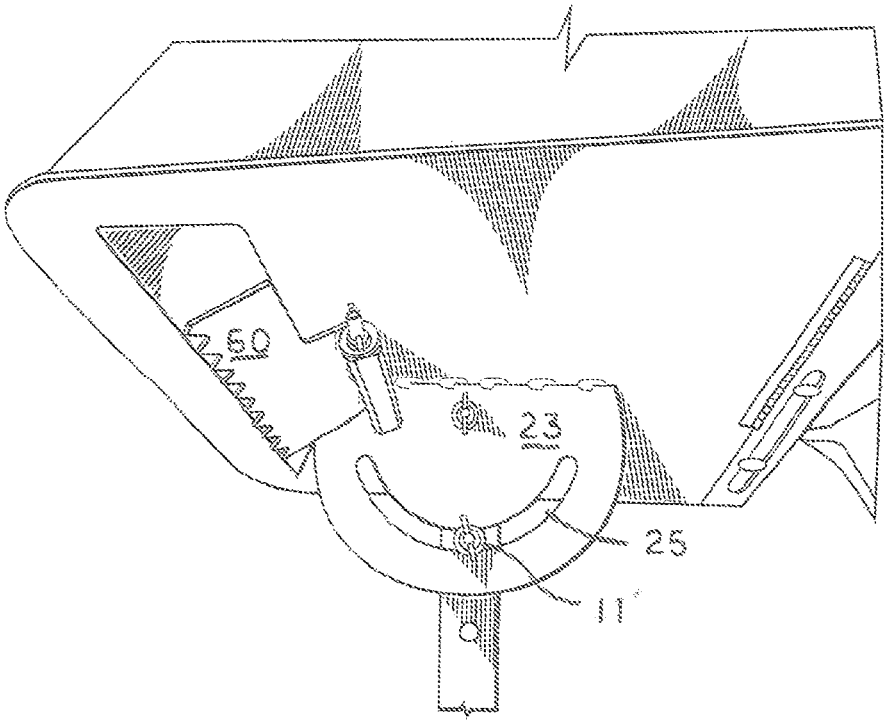
FIG. 17 shows a serrated paper cutter pivotally attached to a slotted plate supported by the front paper crumpler stand whereby the crumpling device is pivotally mounted onto the stand.

Mounted on the back side of the vertical support plate 42 is the motor controller 52. Inputs to the motor controller are the speed select dial 28, the power on switch 27, the paper feed jog button 24 and the foot feed button 62. The jog button 24 is useful for loading the paper. On the left side of the paper crumpler 66 is the speed select dial 28 and a power on button 27. On the right side of the paper crumpler 66 is a paper feed button 24. The foot feed switch is on the floor. The output of the motor controller drives the motor 68. The driven roller 40 is mounted directly to the drive shaft of the motor 68. The motor 68 only runs when the foot feed switch 62 or the paper feed switch 24 is pressed. The motor is stopped at all other times. As shown in FIG. 11 the discharge chute of the paper crumpler and the variable speed control for the potentiometer of the 110 volt input frequency drive drives the 230 volt three phase motor;

To thread the roll of paper, facing the front feed end of the paper crumpling machine, lay the roll 6 of paper in the unrolling section 64 so that as the paper is pulled, the roll 6 will roll counter-clockwise. Pull the free end of paper upward and fold or crumple the end of the paper. Push and hold the paper feed button 24 and insert the crumpled end of the paper into and through the feed chute 26. The end of the paper will be pulled between the idler roller 49 and the driven roller 40. The paper is pushed into the underside of the diverter plate 50 and on between the idler 44 and the driven roller 40. The paper is pushed on through the outfeed chute 30 down past the knife 60. Now the operator can walk to the left or outfeed side of the paper crumpling machine. The operator can now step on the foot feed switch 62 to engage the drive roller and crumple a selected amount of paper. Upon processing the required volume of paper, the paper cut off or torn off by pulling it against the straight edge or serrated edge paper cutter. As shown in FIG. 17, the paper cutter 60 is pivotally mounted to the slotted support disc 23 in order to adjust the angle of the paper cutter.

The second vertical stand has a paper roll cradle 16 supported by the second stand 13. The cradle 16 includes a front rectangular panel or tray 51 extending from a pair of spaced apart trapezoid shaped side plates 152, 153 at a selected upward angle of less than 90 degrees and preferably about 60 degrees forming an upward sloped wall having an upper edge defining an outward turned lip 54 bent downward at about a 15 degree angle. The bottom of the panel 51 may be bent upward forming a bottom inward facing longitudinal flange 57 horizontal with the floor. A rear stop bar or roller guard 56 extends from the opposing top corners of the trapezoid shaped side plates. A rear longitudinal member, comprising a length of angle iron 55, extends between the bottom rear corners of the trapezoid side panels below and aligned with the rear stop bar 56, with the bottom flange turned inward and the top flange turned upward. A horizontal paper roll idler roller comprising a cylinder (paper roll support cylinder) 17 preferably having ball or roller bearings is affixed to the bottom center section of the opposing trapezoid shaped side plates spaced apart from and between the front rectangular panel and the rear longitudinal member. In one preferred embodiment, the paper roll support cylinder is spaced about five inches from the panel. The paper roll support cylinder 17 extends about one inch above an inside surface 59 of the panel 51 and parallel to the panel 51 and rear longitudinal member 55.

The roll of paper rests on an idler roller paper roll support cylinder 17 and is cradled against the tray 51. The paper roll support cylinder 17 bearing the weight of the paper roll 6 is positioned so that upon pulling the paper centers the roll over the idler roller spacing the roll of paper apart slightly from the back wall surface 59 of the tray 51. Pulling the paper ribbon 5 from the paper roll 6 pulls the paper roll 6 forward slightly to redistribute more of its weight on top of the paper roll support cylinder 17 so that the paper roll 6 does not touch and/or minimizes touching the back wall surface 59 of the tray 51 and impart drag on the paper roll 6 during operation. When the drive roller 40 stops pulling the paper ribbon 5, the slack in the paper ribbon 5 between the paper roll 6 and drive roller 40 allows the paper roll 6 to rock back against the rear wall surface 59 of the paper tray 51 imparting drag and acting as a frictional brake to rotation of the paper roll 6 preventing free wheeling and bird nesting of the paper ribbon feed. A plastic, polymer coating or lining may be use to cover or coat the back wall of the tray to enhance the friction between the paper roll and back wall.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A paper crumpling apparatus comprising:

a support stand extending from a base; a frame pivotally attaching to said support stand;

said frame including a housing;

said frame including a vertical support plate disposed within said housing;

said support plate including a first side including an electric motor and means of controlling said motor;

said support plate including a roller assembly affixed to a second side in cooperative engagement with said electric motor, said roller assembly including a pressure plate pivotally mounting to said second side of said support plate, said pressure plate exerting downward pressure due to biasing means in cooperative engagement therewith mounting to said support plate;

a rocker plate pivotally mounting below said pressure plate supports said roller assembly;

said roller assembly including a front idler roller mounting thereto and a rear idler roller spaced apart therefrom, a drive roller spaced apart from and disposed between said rear idler roller and said front idler roller, and a diverter plate mounting to said rocker plate between said rear idler roller and said front idler roller spaced a selected distance above said drive roller;

said housing including a front feed chute and a rear discharge chute on flow communication with said roller assembly;

a detachable paper feed dampener projecting forward and tilting downward at a selected angle from said housing below said feed chute, said detachable paper feed dampener having an inwardly curving end portion for supporting and guiding a feed paper sheet into said feed chute, said feed dampener imparting frictional drag to said feed paper sheet; and a paper tray for supporting a roll of paper spaced apart from and in alignment with said detachable paper feed dampener.

2. The paper crumbling apparatus of claim 1, wherein a vertical center of said detachable paper feed dampener is curved outward to enhance drag.

3. The paper crumbling apparatus of claim 1, wherein a distal end of said detachable paper feed dampener is free to flex up and down a selected distance of up to 30 degrees.

4. The paper crumbling apparatus of claim 1, wherein a distal end of said detachable paper feed dampener is free to flex up and down a selected distance of from 5 to 10 degrees.

5. The paper crumbling apparatus of claim 1, wherein said detachable paper feed dampener includes an adjustable arm extending therefrom to said support stand for positioning said detachable paper feed dampener with respect to said paper feed roll.

6. The paper crumbling apparatus of claim 1, wherein said biasing means in cooperative engagement with said pressure plate is a spring.

7. The paper crumbling apparatus of claim 1, wherein said paper tray defines a paper roll cradle comprising a front panel extending from a pair of spaced apart side plates at a selected upward angle of less than 90 degrees forming an upward sloped wall, said front panel including a bottom inward facing longitudinal flange horizontal with a floor, a rear stop bar extending from opposing top corners of said side plates, a rear longitudinal member extending between said side panels and aligned with said rear stop bar, a horizontal paper roll support cylinder comprising a rotating cylinder affixed to a bottom center section of said side plates, wherein said roll support cylinder supports said roll of paper cradled against said front panel of said paper tray in a rest position and said roll of paper is positioned over said paper roll support cylinder spacing the roll of paper apart slightly from said front panel of said tray during rotation.

8. The paper crumbling apparatus of claim 1, wherein said drive roller comprises a friction surface.

9. The paper crumbling apparatus of claim 1, wherein said drive roller comprises a rubber friction surface.

10. The paper crumbling apparatus of claim 1, wherein said drive roller, said front idler roller, and said rear idler roller comprise a rubber surface.

11. A process for crumbling paper comprising the steps of:

feeding a sheet of paper from a roll of paper into a paper crumbling apparatus comprising a support stand extending from a base; a frame pivotally attaching to said support stand; said frame including a housing; said frame including a vertical support plate disposed within said housing; said support plate including a first side including an electric motor and means of controlling said electric motor; said support plate including a roller assembly affixed to a second side in cooperative engagement with said electric motor, said roller assembly including a pressure plate pivotally mounting to said second side of said support plate, said pressure plate exerting downward pressure due to biasing means in cooperative engagement therewith mounting to said support plate; a rocker plate pivotally mounting below said pressure plate supports said roller assembly; said roller assembly including a front idler roller mounting thereto and a rear idler roller spaced apart therefrom, a drive roller spaced apart from and disposed between said rear idler roller and said front idler roller, and a diverter plate mounting to said rocker plate between said rear idler roller and said front idler roller spaced a selected distance above said drive roller; said housing including a front feed chute and a rear discharge chute on flow communication with said roller assembly;

imparting frictional drag to said sheet of paper with a detachable paper feed dampener projecting forward and tilting downward at a selected angle from said housing below said feed chute, said detachable paper feed dampener having an inwardly curving end portion for supporting and guiding said sheet of paper into said feed chute; supporting said roll of paper on a roll support cylinder cradled against a front panel of a paper tray spaced apart from and in alignment with said detachable paper feed dampener;

pulling said sheet of paper from said roll of paper forward slightly to redistribute the weight of said roll of paper on a top surface of said roll support cylinder minimizing contact of said paper roll of against a front panel of the paper tray;

allowing said roll of paper to rock back against said front panel of said paper tray upon ceasing pulling of said sheet of paper from said roll of paper imparting drag on said roll of paper preventing freewheeling and bird nesting of said sheet of paper by braking said roll of paper.

12. The process for crumbling paper of claim 11, including the step of coating said front panel of said paper tray with a friction enhancing coating.

* * * * *